US009874083B2

(12) United States Patent
Logan et al.

(10) Patent No.: US 9,874,083 B2
(45) Date of Patent: Jan. 23, 2018

(54) DOWNHOLE PROBES AND SYSTEMS

(71) Applicant: EVOLUTION ENGINEERING INC., Calgary (CA)

(72) Inventors: Aaron W. Logan, Calgary (CA); Patrick R. Derkacz, Calgary (CA); Justin C. Logan, Calgary (CA); David A. Switzer, Calgary (CA)

(73) Assignee: Evolution Engineering Inc., Calgary (CA)

( * ) Notice: Subject to any disclaimer, the term of this patent is extended or adjusted under 35 U.S.C. 154(b) by 238 days.

(21) Appl. No.: 14/650,511

(22) PCT Filed: Dec. 18, 2013

(86) PCT No.: PCT/CA2013/050986
§ 371 (c)(1),
(2) Date: Jun. 8, 2015

(87) PCT Pub. No.: WO2014/094163
PCT Pub. Date: Jun. 26, 2014

(65) Prior Publication Data

US 2015/0308258 A1 Oct. 29, 2015

Related U.S. Application Data

(60) Provisional application No. 61/739,592, filed on Dec. 19, 2012.

(51) Int. Cl.

| | |
|---|---|
| ***E21B 47/00*** | (2012.01) |
| ***E21B 47/01*** | (2012.01) |
| ***E21B 33/038*** | (2006.01) |
| ***E21B 47/12*** | (2012.01) |
| *H01R 13/523* | (2006.01) |

(52) U.S. Cl.
CPC ..... *E21B 47/01* (2013.01); *E21B 33/0385* (2013.01); *E21B 47/12* (2013.01); *H01R 13/523* (2013.01)

(58) Field of Classification Search
USPC ..... 73/142.54
See application file for complete search history.

(56) References Cited

U.S. PATENT DOCUMENTS 4,196,781 A * 4/1980 Cheek ..... E21B 7/04 175/321
4,454,756 A * 6/1984 Sharp ..... E21B 47/022 33/313

(Continued)

FOREIGN PATENT DOCUMENTS

WO 2002078946 A1 10/2002

*Primary Examiner* — Clayton E Laballe
*Assistant Examiner* — Warren K Fenwick
(74) *Attorney, Agent, or Firm* — Oyen Wiggs Green & Mutala LLP

(57) ABSTRACT

Disclosed are downhole probes in which electrical interconnections between different modules are achieved without wiring harnesses. Modules may be coupled to one another and/or to bulkheads in the probe my couplings that provide substantially rigid couplings. The couplings may be configured to connect together only in one orientation. Electrical connectors may be fixed relative to components of the couplings so that the electrical connectors are automatically aligned for connection by the couplings.

37 Claims, 15 Drawing Sheets

(56) References Cited

U.S. PATENT DOCUMENTS

| | | | | |
|---|---|---|---|---|
| 4,537,067 | A * | 8/1985 | Sharp | E21B 47/022 374/136 |
| 5,203,723 | A * | 4/1993 | Ritter | H01R 13/521 439/589 |
| 6,247,542 | B1 * | 6/2001 | Kruspe | E21B 33/1243 166/66 |
| 6,582,251 | B1 | 6/2003 | Burke et al. | |
| 6,839,000 | B2 * | 1/2005 | Das | G01V 11/00 166/254.2 |
| 8,203,908 | B2 | 6/2012 | Pratt et al. | |
| 8,251,160 | B2 | 8/2012 | Gopalan et al. | |
| 2005/0016769 | A1 * | 1/2005 | Wallace | E21B 17/028 175/40 |
| 2005/0070141 | A1 * | 3/2005 | Dopf | E21B 17/028 439/140 |
| 2009/0025926 | A1 * | 1/2009 | Briquet | E21B 49/10 166/105 |
| 2010/0212963 | A1 * | 8/2010 | Gopalan | E21B 47/187 175/40 |
| 2014/0150544 | A1 * | 6/2014 | Logan | E21B 47/01 73/152.03 |

* cited by examiner

DOWNHOLE PROBES AND SYSTEMS

CROSS REFERENCE TO RELATED APPLICATIONS

This application claims priority from U.S. Application No. 61/739,592 filed 19 Dec. 2013. For purposes of the United States, this application claims the benefit under 35 U.S.C. §119 of U.S. Application No. 61/739,592 filed 19 Dec. 2013 and entitled DOWNHOLE PROBES AND SYSTEMS which is hereby incorporated herein by reference for all purposes.

TECHNICAL FIELD

This invention relates to subsurface drilling, particularly subsurface drilling involving the use of downhole probes. Some embodiments are applicable to directional drilling of wells for recovering hydrocarbons.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid, usually in the form of a drilling "mud", is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at surface.

Bottom hole assembly (BHA) is the name given to the equipment at the terminal end of a drill string. In addition to a drill bit, a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars; pulsers; and the like. The BHA is typically advanced into the wellbore by a string of metallic tubulars (drill pipe).

Modern drilling systems may include any of a wide range of mechanical/electronic systems in the BHA or at other downhole locations. Such electronics systems may be packaged as part of a downhole probe. A downhole probe may comprise any active mechanical, electronic, and/or electromechanical system that operates downhole. A probe may provide any of a wide range of functions including, without limitation: data acquisition; measuring properties of the surrounding geological formations (e.g. well logging); measuring downhole conditions as drilling progresses; controlling downhole equipment; monitoring status of downhole equipment; directional drilling applications; measuring while drilling (MWD) applications; logging while drilling (LWD) applications; measuring properties of downhole fluids; and the like. A probe may comprise one or more systems for: telemetry of data to the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids; etc. A downhole probe is typically supported in a bore of a drill string near the drill bit. Some downhole probes are highly specialized and expensive.

Downhole conditions can be harsh. A probe may experience high temperatures; vibrations (including axial, lateral, and torsional vibrations); shocks; immersion in drilling fluids; high pressures (20,000 p.s.i. or more in some cases); turbulence and pulsations in the flow of drilling fluid past the probe; fluid initiated harmonics; and torsional acceleration events from slip which can lead to side-to-side and/or torsional movement of the probe. These conditions can shorten the lifespan of downhole probes and can increase the probability that a downhole probe will fail in use. Replacing a downhole probe that fails while drilling can involve very great expense.

A downhole probe may communicate a wide range of information to the surface by telemetry. Telemetry information can be invaluable for efficient drilling operations. For example, telemetry information may be used by a drill rig crew to make decisions about controlling and steering the drill bit to optimize the drilling speed and trajectory based on numerous factors, including legal boundaries, locations of existing wells, formation properties, hydrocarbon size and location, etc. A crew may make intentional deviations from the planned path as necessary based on information gathered from downhole sensors and transmitted to the surface by telemetry during the drilling process. The ability to obtain and transmit reliable data from downhole locations allows for relatively more economical and more efficient drilling operations.

Telemetry techniques that may be used to carry information from a downhole probe to the surface include transmitting information by generating vibrations in fluid in the bore hole (e.g. acoustic telemetry or mud pulse (MP) telemetry) and transmitting information by way of electromagnetic signals that propagate at least in part through the earth (EM telemetry). Other telemetry techniques use hardwired drill pipe, fibre optic cable, or drill collar acoustic telemetry to carry data to the surface.

In directional drilling, information from a downhole probe can be essential to guiding the drilling to follow a desired trajectory. For example, the downhole probe may include sensors to detect inclination and heading of the drill string.

Reliability is one problem encountered in drilling with downhole probes. As noted above, failure of a downhole probe can be very costly. It would be beneficial to be able to construct downhole probes in such a manner that the probes have enhanced reliability under downhole conditions.

Another problem encountered in downhole drilling is determining and/or setting an alignment between sensors in a downhole probe and the orientation of other components of a drill string. For example, in directional drilling it can be convenient or necessary to know the relative orientation between sensors in a downhole probe and the high side of a bent sub. It would be desirable to provide a downhole probe and related drill string components such that the relative alignment between sensors in a probe and a bent sub or other drill string component can be readily determined and/or set.

SUMMARY

This invention has a number of different aspects. While these aspects can be exploited to advantage together, this is not mandatory. Some aspects may be exploited independently of other aspects. Some example aspects include: downhole probes useful for subsurface drilling having hard-mounted electronic components; a range of couplings useful for coupling modules within a downhole probe to other modules or to bulkheads of the probe; modular downhole probes; modules for use in downhole probes; downhole assemblies including downhole probes and having indicia for indicating sensor orientation; and downhole probes having reduced or eliminated wiring harnesses.

An example aspect of the invention provides a downhole probe comprising an elongated housing and first and second modules arranged in a row and fixed relative to one another within the housing. Each of the first and second modules comprises one or more electrical components and is electrically connected to the other one of the first and second modules by way of an electrical connection. The electrical connection comprises: a first electrical connector attached to the first module and electrically connected to one or more of the electrical components of the first module by one or more immobilized first electrical conductors; and a second electrical connector attached to the second module and electrically connected to one or more of the electrical components of the second module by one or more immobilized second electrical conductors. The first and second electrical connectors are either directly coupled to one another or electrically connected to one another by immobilized conductors.

Another example aspect provides a downhole probe comprising a housing comprising a plurality of bulkheads including first and second terminal bulkheads at either end of the probe and at least one intermediate bulkhead between the terminal bulkheads. A tubular shell extends between the terminal bulkheads. The tubular shell is interrupted by and coupled to each of the at least one intermediate bulkheads. A first one or more of the plurality of modules is contained within a first section of the tubular shell that is coupled to one side of a first one of the intermediate bulkheads. A second of the plurality of modules is contained within a second section of the tubular shell coupled to an opposing side of the first intermediate bulkhead. The first one or more of the plurality of modules are rigidly anchored to the housing and the second module is electrically coupled to the first one or more modules by a rotary coupling comprising a projection that extends through and is supported within a bore passing through the first intermediate bulkhead.

Another example aspect provides a rotary coupling for use in a downhole probe. The rotary coupling comprises a bulkhead having a central bore, an outside of the bulkhead comprising threads for coupling the bulkhead to a tubular housing section, a sleeve supported within the bore, and a male projection extending through the bore into the sleeve. The sleeve comprises a cylindrical cavity that receives the male projection. The male projection has a first part snuggly fitted in the bore and a second part extending into the sleeve. The second part comprises circumferential conductive bands spaced apart along the male projection. One or more brushes are provided on the sleeve and arranged to contact the conductive bands.

Some particular embodiments include sensors for gravity, magnetic fields or other vector quantities.

Another example aspect provides downhole apparatus comprising a drill string section and a downhole probe supported within the drill string section. The downhole probe comprises one or more directional sensors. The sensors have a reference orientation. The sensors are located within a module that is supported within a housing of the downhole probe. The module containing the one or more sensors has non-rotational couplings and is directly or indirectly by way of others of the modules rigidly coupled to the housing. The sensors are mounted within the module on members (e.g. circuit boards) that are mounted to have a defined orientation relative to the non-rotational coupling. The housing is non-rotatably coupled to the drill string section. An outside of the drill string section comprises indicia indicating the reference orientation.

Further aspects of the invention and features of example embodiments are illustrated in the accompanying drawings and/or described in the following description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
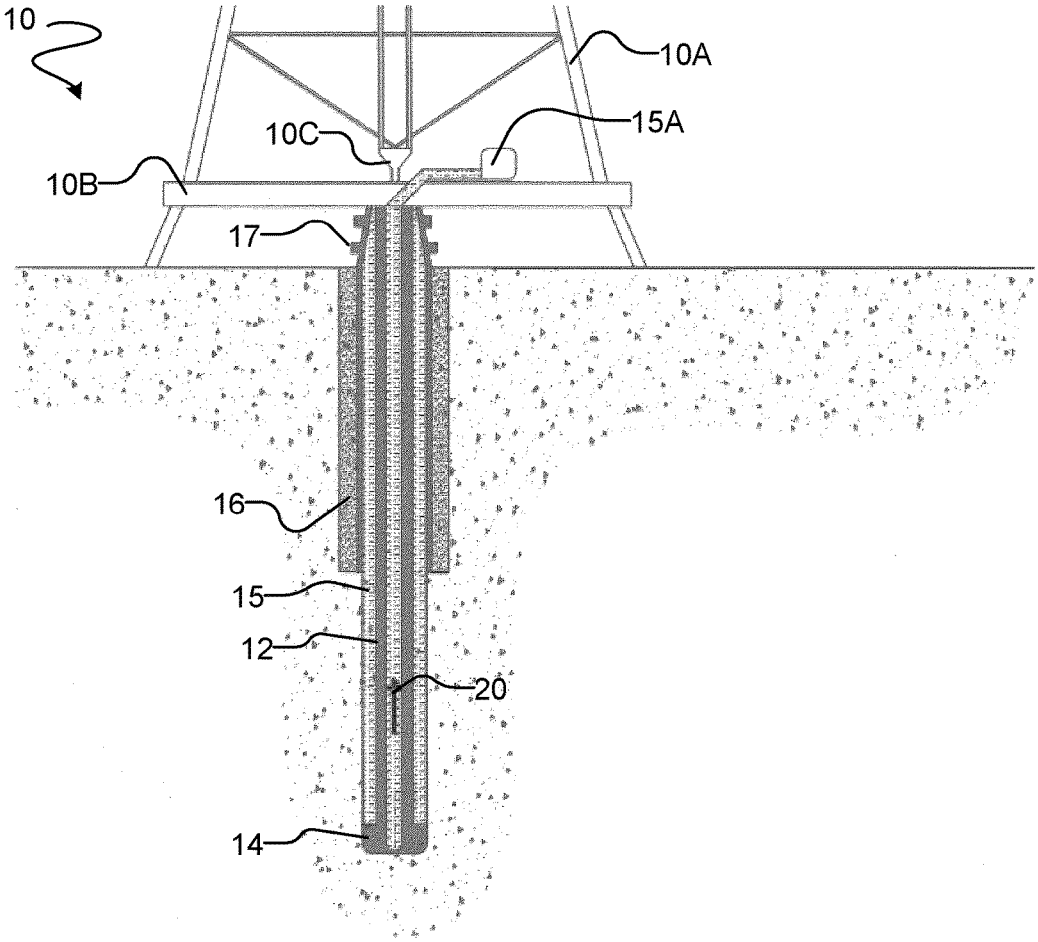
FIG. 1 is a schematic view of a drilling operation.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B and draw works 10C for supporting the drill string. Drill bit 14 is larger in diameter than the drill string above the drill bit. An annular region 15 surrounding the drill string is typically filled with drilling fluid. The drilling fluid is pumped through a bore in the drill string to the drill bit and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig.

Figure 2:
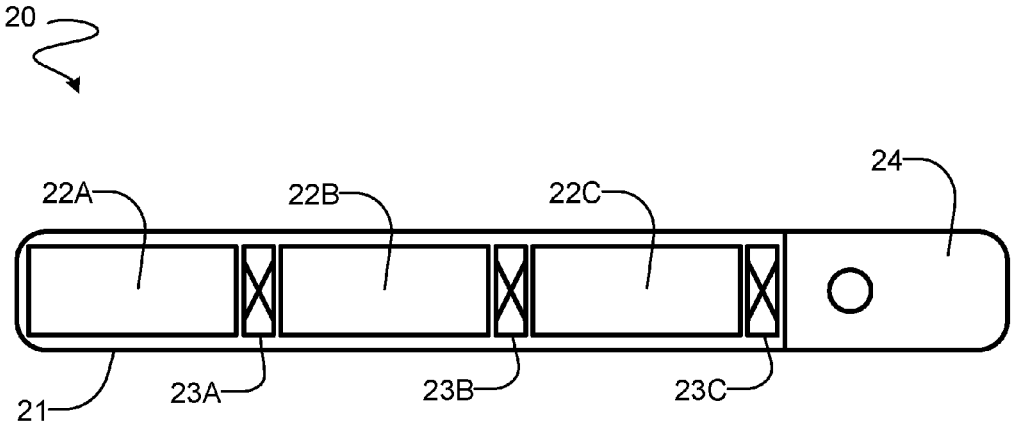
FIG. 2 shows schematically an example downhole probe.

FIG. 2 shows schematically an example downhole probe 20. Downhole probe 20 comprises a probe housing 21. Within probe housing 21 are active components such as suitable sensors, electronic circuits, batteries and the like that provide desired functionality. In the illustrated embodiment the active components are divided into three modules, 22A, 22B and 22C. Other embodiments could have more or fewer modules. The modules are electrically interconnected by electrical connections (connections 23A and 23B are shown in FIG. 2). A mud pulse motor 24 is coupled to one end of probe 20. Mud pulse motor 24 is coupled to active components of probe 20 by way of an electrical connection 23C.

Probes according to some embodiments achieve increased reliability by reducing or eliminating flexible wire harnesses between modules. Such flexible wire harnesses are common in prior art downhole probes. In many prior art downhole probes different modules are electrically connected by way of multi-pin plug-together electrical connectors. A wire harness comprising several electrical wires in a bundle or a pigtail extends between the electrical connectors. The electrical harness is typically free to flex under the influence of downhole vibrations. Such flexing can result in premature failure of the wire harness or its connections. The inventors have determined that faults in such wire harnesses are a frequent cause of probe failures.

Some embodiments are constructed in such a manner that different modules 22 each incorporate an electrical coupling that is rigidly fixed to the module. Electrical connections between modules 22 are made directly by elements of the couplings. No flexible wire harnesses are required. The modules may be structured to minimize motion of the coupled electrical couplings relative to one another. To this end, probes may be constructed in such a manner that connected modules 22 are not free to move significantly relative to one another. This may be achieved, for example, by rigidly mounting each of the modules so that it is fixed relative to probe housing 21. Probe housing 21 is designed to withstand downhole pressures (e.g. pressures on the order of 20,000 psi (about 138 MPa)). Consequently the probe housing typically offers significant mechanical strength.

In some embodiments coupling of a module 22 to probe housing 21 may comprise providing a size-on-size fit of an outer surface of the module inside a bore of the housing. The fit may be a close-tolerance fit which is loose enough for the module to be assembled into the probe housing by sliding the module into the probe housing but tight enough that there is virtually no room for relative lateral motion between the module and the probe housing when the module is within the bore of the probe housing. When the probe is downhole, external pressure may compress the probe housing against the outer surfaces of the modules, thereby further preventing movement of the modules relative to one another.

Modules 22 may, for example, comprise generally cylindrical bodies within which components are embedded in a suitable potting compound (such as, for example, a suitable epoxy). In an example embodiment a module 22 has a tubular outer shell. Active components (e.g. electronics) are contained within the shell. The shell may, for example, comprise a tubular shell of a composite material such as a carbon fiber composite, fiberglass or the like. The shell may be of a self-lubricating material and/or an outer surface of the shell may be lubricated (for example with a suitable grease) to facilitate sliding insertion of the module 22 into probe housing 21 as well as removal of the module 22 from probe housing 21.

Where the bore of housing 21 is cylindrical, suitable means may be provided to prevent modules 22 from rotating within probe housing 21. In some embodiments, modules 22 are coupled to one another at bulkhead fittings which couple together different sections of probe housing 21 and the modules 22 interface to the bulkhead fittings in a manner that prevents rotation of the modules 22. In some embodiments, a first module 22 is non-rotationally engaged with a bulkhead fitting and a second module 22 is non-rotationally engaged with the first module 22. In either case, coupled modules 22 are prevented from moving relative to one another to any significant degree. Therefore, the electrical couplings between the modules are protected to a significant degree from being degraded by vibrations and shocks. Wires internal to each module that lead to and from the electrical connectors may be embedded in potting material or rigidly supported in some other manner such that they are prevented from significant flexing under downhole vibrations and shocks. The support may extend right to the electrical connectors.

The construction described above is in contrast to those prior downhole probes in which electronics assemblies are mounted within the probe by resilient snubber assemblies which permit relative motion between the electronics and the probe housing and between different electronics assemblies supported within the probe by different snubber assemblies. Where modules are mounted rigidly within probes the modules may be arranged relative to the housing such that there is no internal offset of sensors within the probe. One or more sensors in the modules of the probe that are directional (e.g. inclination sensors, magnetic field sensors, accelerometers, etc.) may be aligned relative to the probe housing and/or relative to one another in a known predetermined manner that is automatically preserved by the rigid coupling of modules into the probe when the probe is assembled.

Coupling modules to one another and/or to bulkheads in a probe in such a way that there is no significant relative movement of the modules while providing electrical connections between the modules can be achieved using various coupling designs. In preferred embodiments the couplings have one or more of the following features: when the coupling is engaged, axial motion is prevented; when the coupling is engaged, rotational motion is prevented; the coupling can be engaged in only one orientation; the coupling includes mating electrical connectors that are automatically aligned for connection when the coupling is engaged; the coupling is arranged such that the coupling forces correct relative orientation of the parts of the coupling before the mating electrical connectors contact one another; the basic design of the coupling is such that it facilitates making similar couplings that cannot be mated together. Some example couplings that may be used in non-limiting embodiments of the invention are described below.

Figure 3:
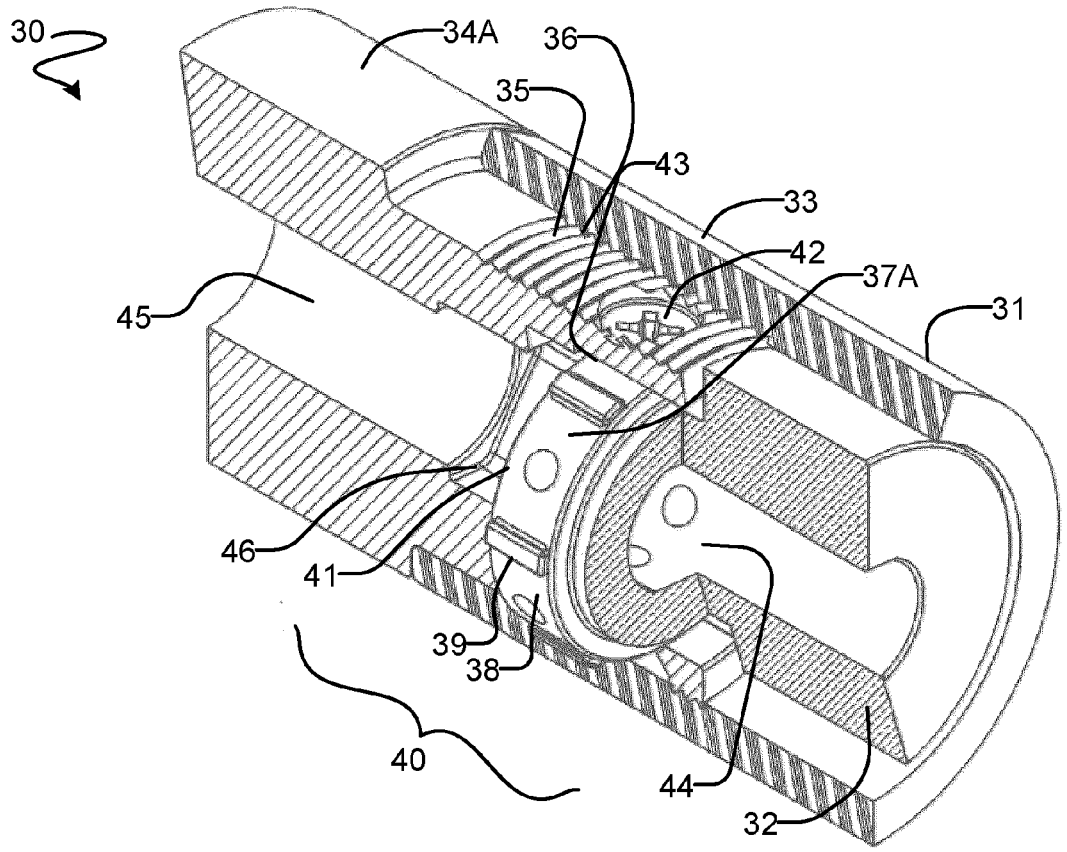
FIG. 3 is a partial partially cut away view of a part of a probe according to an example embodiment.
Figure 3A:
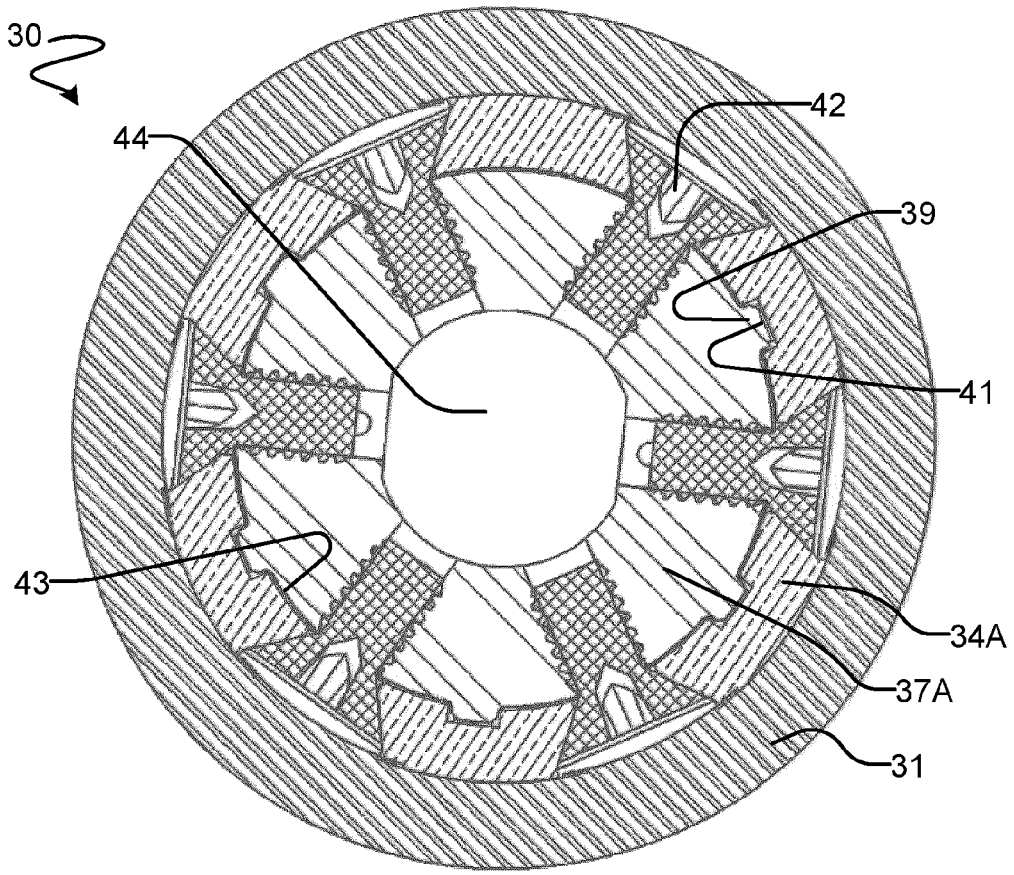
FIG. 3A is a cross section through a bulkhead of the probe of FIG. 3.

FIG. 3 is a partial partially cut away view of a part of a probe 30 according to an example embodiment. Probe 30 comprises a housing 31 made up of tubular sections 33 coupled to bulkheads 34. Housing 31 may, for example, be made of suitable metals such as stainless steel, beryllium-copper or the like. FIG. 3A is a cross section through a bulkhead of probe 30.

In the illustrated embodiment, bulkheads 34 have male threads 35 that engage female threads 36 of tubular sections 33.

In some embodiments, modules within probe 30 comprise couplings that enable them to be coupled to one another and/or to bulkheads 34. Such couplings may comprise corresponding male and female parts. The couplings may prevent coupled modules from rotating relative to one another or relative to the probe housing and from moving axially within the probe housing.

FIGS. 3 and 3A illustrate an example coupling 40 between a module 32 and a bulkhead 34A wherein a male connector part 37A is provided on an end of the module 32 and a female connector part is provided as part of bulkhead 34A. Male connector part 37A comprises a cylindrical hub 38 that is smaller in diameter than module 32. Longitudinally-extending ribs or fins 39 are provided on the outer surface of hub 38.

Bulkhead 34A has a cylindrical recess 43 dimensioned to receive hub 38. Longitudinal grooves 41 in the walls of recess 43 receive fins 39. Male connector part 37A can be slid into engagement in recess 43. Recess 43 may be tapered in diameter such that the fit between male connector part 37A and recess 43 becomes tighter as male connector part 37A is slid deeper into recess 43. The engagement of fins 39 in grooves 41 positively prevents relative rotation of male connector part 37A relative to bulkhead 34A.

Advantageously, fins 39 and grooves 41 are arranged asymmetrically such that male connector part can fit into recess 43 only in one relative orientation. The number of fins or ribs 39 may be varied. In some embodiments male part 37A bears four to eight fins or ribs 39.

Once assembled together, male connector part 37A may be secured to bulkhead 34A in any suitable manner. In the illustrated embodiment, screws 42 pass through bulkhead 34A into male connector part 37A. For example, four to eight screws 42 may be spaced apart around the periphery of bulkhead 34A. In some embodiments, a screw 42 is provided between each adjacent pair of fins 39. Preferably screws 42 thread into blind holes in male connector part 37A.

In addition to screws 42, a suitable bedding material, such as a curable epoxy may be applied around screws 42 and/or between male connector part 37A and bulkhead 34A. The bedding material may assist in reducing shear forces on screws 42. In the illustrated embodiment, screws 42 are countersunk so that, when installed, their heads are below the roots of external threads 35.

A bore 44 extends through male connector part 37A. A bore 45 extends through bulkhead 34A. Module 32 includes an electrical connector (not shown in FIG. 3) that is fixed relative to male connector part 37A. The electrical coupler may, for example, comprise a high-reliability MDM or Micro-D type connector. Such connectors are available in a wide variety of pin configurations.

Module 32 may be electrically interconnected to another module (not shown) that is located on the opposite side of bulkhead 34A. The electrical coupling may comprise coupling between a connector on module 32 and a corresponding connector on the other module. The connector of module 32 may be recessed within bore 44, located axially at the opening of bore 44 or may be supported on a member that projects from bore 44. The mating connector is mounted such that it engages the connector of module 32 to complete electrical, optical or other connections between the modules. Where a connector from either module is mounted to a member that extends through bore 45 of bulkhead 34A, the member on which the connector is mounted may be a close sliding fit in bore 45 such that the member cannot undergo significant transverse vibrations independently from bulkhead 34A.

In some embodiments a pair of electrical connectors coupled by suitable electrical conductors are supported in the bore 45 of bulkhead 34A. The electrical conductors between the connectors and back sides of the connectors themselves may be potted in epoxy or another suitable potting material. The connectors and associated electrical conductors may be mounted on a member that fits tightly and non-rotationally into bore 45. The connectors may be oriented to receive complementary electrical connectors on modules 32 on either side of the bulkhead. In alternative embodiments (as illustrated, for example in FIG. 6) a connector on module 32 is coupled electrically to a connector on another module by way of a rotary coupling that extends through the bore of bulkhead 34A.

FIG. 3 illustrates a general type of connection that may be embodied in various ways. For example, modules may be rigidly coupled to one side of bulkhead 34A or to both sides of bulkhead 34A. Electrical connections between the modules may be provided directly between electrical connectors attached to the modules. In such embodiments one or both of the electrical connector may be mounted on a projection that extends from the module into or through the bore of bulkhead 34A for connection with the mating connector on the other module. In such embodiments the projections may be sized so as to mechanically engage the bore of bulkhead 34A, thereby being supported against transverse vibrations.

In other embodiments an intermediate connecting piece (not shown in FIG. 3) has electrical connectors that couple to mating electrical connectors on both modules. The connecting piece may be at least partly received in the bore of bulkhead 34A. Electrical conductors between the electrical connectors of the coupling piece may be immobilized (for example, by potting, confinement in channels or bores, or the like).

Figure 6:
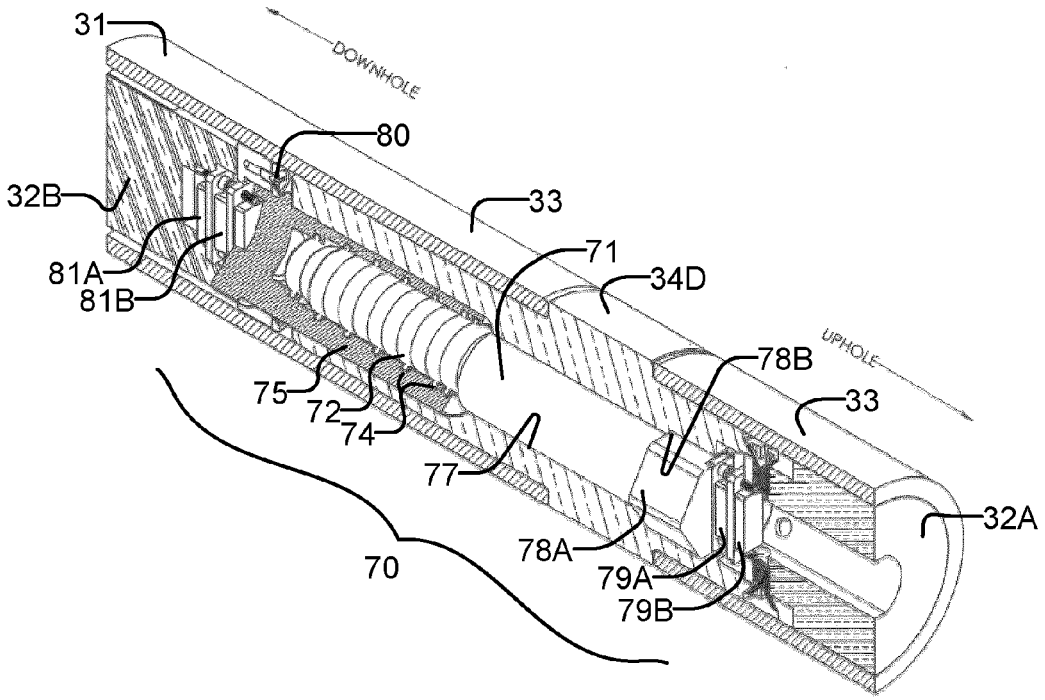
FIG. 6 illustrates a rotary coupling that may be applied where relative rotation may occur between connected modules (either in the process of assembling a probe or for some other reason).

In some embodiments the connecting piece comprises a rotary coupler (an example of which is illustrated in FIG. 6).

Male connector 37A may be made of a suitable plastic, for example. This is advantageous especially where bulkhead 34A is of metal since it eliminates metal-to-metal contact between module 32 and bulkhead 34A. Metal-to-metal contact can result in undesirable pinging (high-frequency vibration) caused when shocks or downhole vibrations cause hard metal surfaces to impact one another. Male connector 37A may, for example comprise an injection-molded part.

Male connector 37A may be attached to module 32 in various ways. In some embodiments, male connector 37A is integral with a cylindrical sleeve or plug that attaches to module 32. For example, male connector 37A may be connected to a plug or sleeve that can be inserted into a tubular outer wall of a module 32. The sleeve or plug may be attached to module 32 in any suitable manner including by way of screws, pins, adhesives, a threaded coupling, or the like. Male connector 37A may be attached to a cap or plug that closes the end of a module 32.

Coupling 40 may be varied in many ways without departing from the broad scope of the invention. For example instead of or in addition to fins 39, male connector 37A may be prevented from rotating relative to bulkhead 34A by making hub 38 have a non-round cross-section and making the cross section of recess 43 complementary to that of hub 38.

Figure 4:
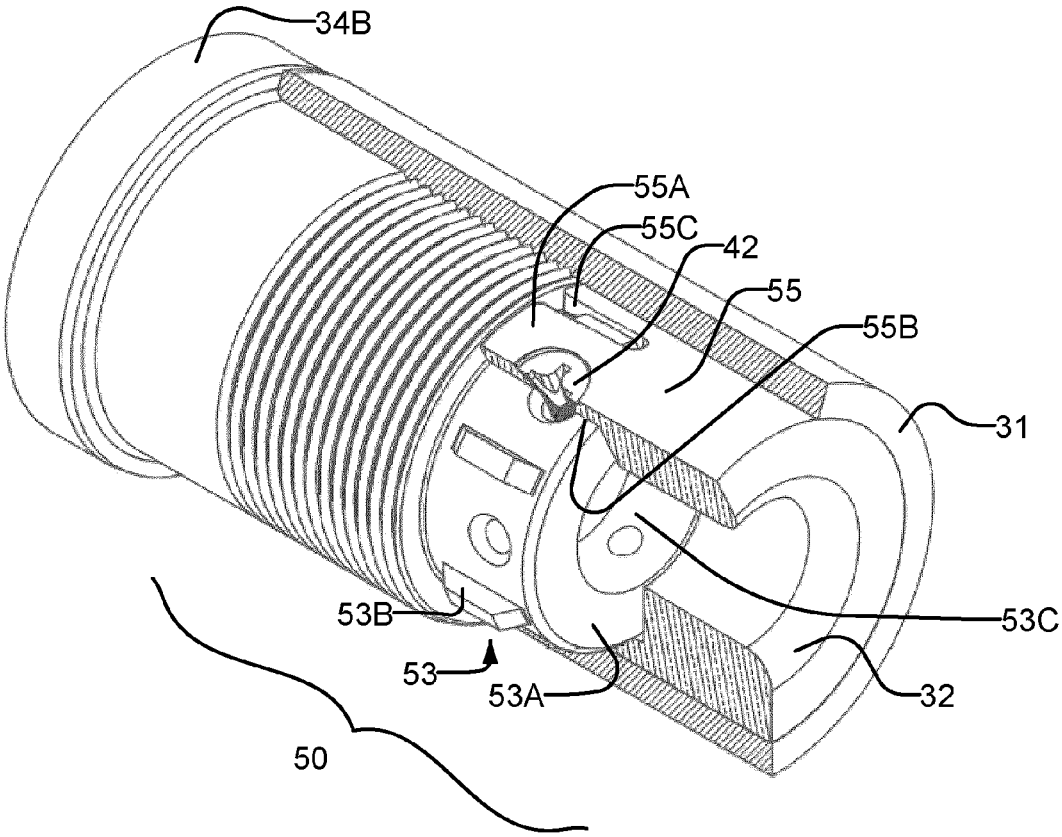
FIG. 4 is a partial, partially cut-away view showing a probe in which a module is coupled to a bulkhead by a coupling having a male part provided on the bulkhead and a female part provided on the module.

FIG. 4 is a partial, partially cut-away view showing a probe in which a module 32 is coupled to a bulkhead 34B by a coupling 50. In coupling 50 a male part 53 is provided on bulkhead 34B and a female part is provided on module 32. Male part 53 may have a configuration that is the same as or similar to the configuration of male connector 37A which is described above. Male part 53 may be fabricated of the same material as bulkhead 34B and may be formed integrally with bulkhead 34B.

In the illustrated embodiment male part 53 comprises a generally cylindrical body 53A having longitudinally-extending ribs or fins 53B spaced apart around its outer surface. Ribs or fins 53B may be arranged asymmetrically (for example, in some embodiments there are N ribs or fins 53B arranged at N of N+1 evenly circumferentially spaced apart locations around body 53A).

Coupling 50 comprises a female part 55 that is attached to a module 32. Female part 55 comprises a cylindrical shell 55A having a cavity 55B dimensioned to receive cylindrical body 53A. Grooves or slots 55C extending longitudinally along the wall of cavity 55B are spaced to receive ribs or fins 53B. In some embodiments, the walls of cavity 55C taper inwardly such that the fit of body 53A into cavity 55B gets tighter as body 53B is fully inserted into cavity 55B.

In the illustrated embodiment, shell 55A has countersunk holes to allow screws 42 to be threaded into holes spaced apart around male part 53. Screws 42 hold the coupling together. An epoxy or other bedding compound may be provided around screws 42 and/or between other parts of the coupling such that the two parts of coupling 50 are held rigidly relative to one another both axially and rotationally. The holes in male part 53 are blind holes in some embodiments.

In some embodiments, female part 55 comprises a suitable plastic material. Female part 55 may, for example, be injection molded. Female part 55 may be integral with a part that provides coupling to a module 32. For example, female part may be connected to a plug or sleeve that can be inserted into a tubular outer wall of a module 32 and affixed by means of suitable pins, screws, adhesives, welding, rivets, a threaded connection or the like. Female part 55 may be attached to a cap or plug that closes the end of a module 32.

As with coupling 40, an electrical connector may be mounted at a fixed location relative to female part 55. A mating electrical connector may be mounted to another module located on a side of bulkhead 34B opposite to male part 53. The electrical connectors are located such that they make reliable electrical connections between one or more electrical conductors when male part 53 and female part 55 are mated together. The electrical connectors may be located on-axis. The specific nature and locations of the electrical connectors may be chosen based on the number of electrical connections required to be made and the nature of the electrical signals and/or power to be carried by the conductors.

Figure 4A:
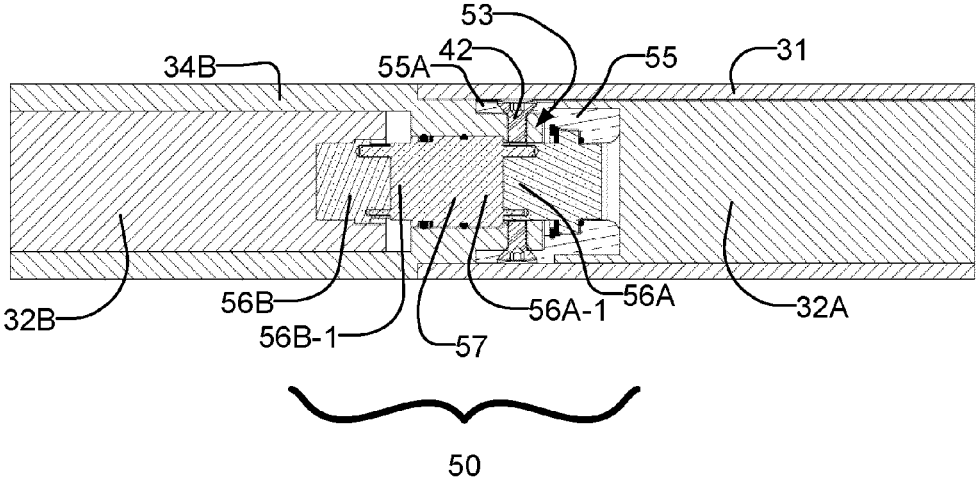
FIG. 4A is a longitudinal cross section of a coupling generally like that of FIG. 4.

In the embodiment illustrated in FIG. 4A, electrical connectors 56A and 56B are respectively attached to modules 32A and 32B. Electrical connectors 56A and 56B mate with corresponding electrical connectors 56A-1 and 56B-1 on a connecting piece 57. Connecting piece 57 is received in the bore of bulkhead 34B and is long enough to connect electrical connectors 56A and 56B. Connecting piece 57 may be a snug fit in the bore of bulkhead 34B. Electrical conductors within connecting piece 57 may be immobilized. In some embodiments, connecting piece 57 is rated to withstand pressure differentials across bulkhead 34B.

An alternative embodiment does not require a connecting piece 57. In the alternative embodiment, electrical connectors are mounted on axial projections that extend from one or both coupled modules into the bore of bulkhead 34B. In such embodiments, the electrical connectors may be within or on either side of the bore through bulkhead 34B. For example, one electrical connector may be supported on a projection that extends axially in the center of cavity 55A and the mating electrical connector may be supported on a second a projection that extends from the other module through the bore of bulkhead 34B. Electrical conductors that connect contacts in the electrical connectors to circuits in the attached modules may be fully supported (e.g. by being embedded in a potting material). This support may extend essentially all the way to the electrical connectors.

Male and female parts of couplers 40 and 50, as described above are not limited in application to coupling modules to bulkheads. Such couplers may also be applied to couple different modules together. Modules 32 may be coupled to one another and/or to bulkheads by couplings as described above. The couplings may provide reliable electrical interconnects between the modules. The couplings also hold the modules against axial and/or rotational motion relative to one another and/or the housing of the probe in which the modules are located.

Figure 5:
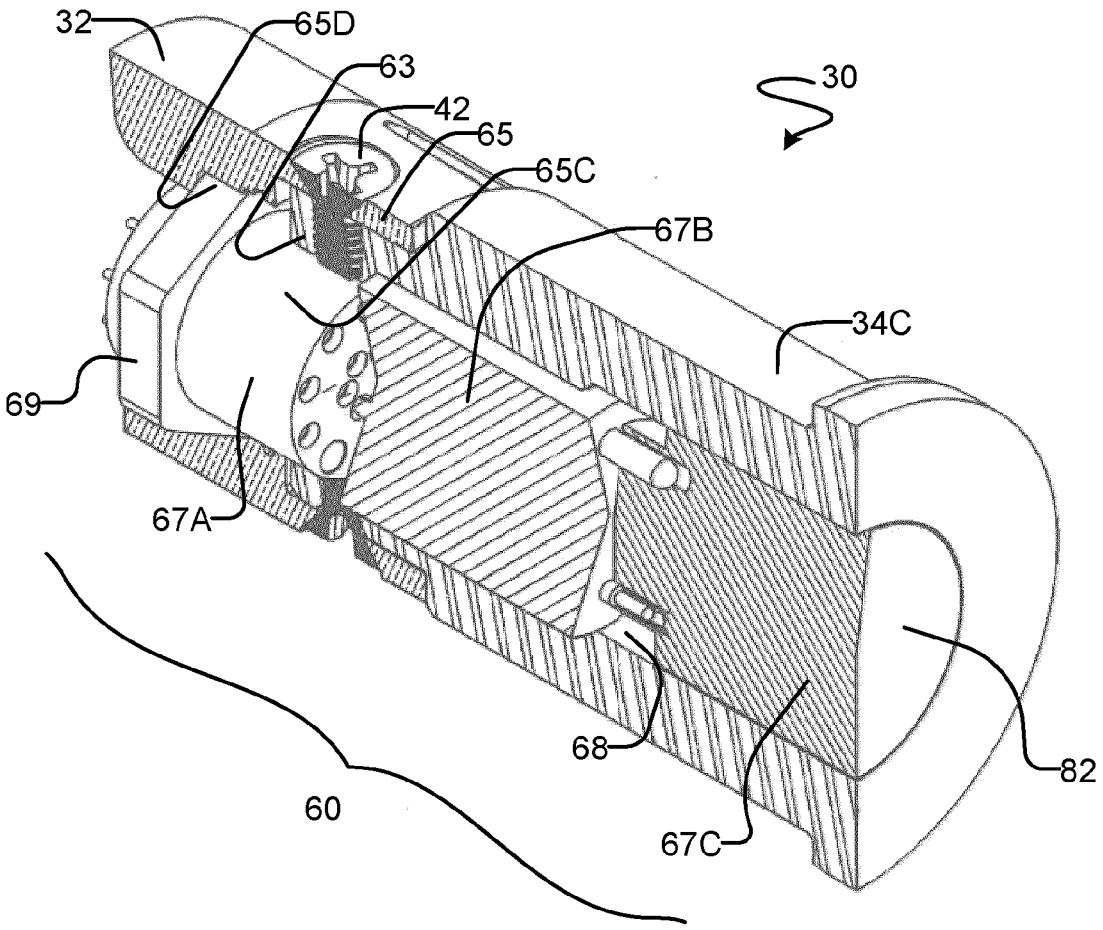
FIG. 5 is a partially cut-away view showing the end part of a probe including a coupling that provides electrical interconnection between a module inside the probe and an external system.

Rigid couplings may also be provided to carry electrical signals to equipment located outside of the probe itself. For example, such rigid couplings may be applied to make electrical connections to a mud pulse motor (which may be used, for example, for mud-pulse telemetry). FIG. 5 is a partially cut-away view showing the end part of a probe 30. A coupling 70 provides electrical interconnection between a module 32 inside probe 30 and a mud pulse motor 82 that is coupled to but outside of probe 30.

Coupling 60 couples module 32 to a terminal bulkhead 34C. In the illustrated embodiment, terminal bulkhead 34C comprises a male part 63 that can be substantially like male part 53 that is described above. The module may have a female part 65 that can be substantially similar to female part 55 that is described above. Female part 65 may have an outside diameter that is a size-on-size fit to probe housing 31. In some embodiments, female part 65 is made of a suitable plastic. In some embodiments male part 63 is made of a metal (for example beryllium-copper). Providing plastic-to-metal contact as opposed to metal-to-metal contact can be advantageous as described above.

In the illustrated embodiment, male part 63 has longitudinal grooves on its outer surface and these longitudinal grooves receive corresponding longitudinal ribs or fins that project inwardly from female part 65. Female part 65 may, for example, have four to eight ribs or fins. The ribs or fins may have an asymmetrical arrangement such female part 65 can be assembled to male part 63 in only one orientation.

A multi-pin electrical connector 67A is supported within a cavity 65C in female part 65. In the illustrated embodiment, connector 67A has a hexagonal flange 69 that engages in a complementary-shaped recess 65D in female part 65 such that connector 67A cannot rotate relative to female part 65. Connector 67A may be held in place in cavity 65D by a snap ring, for example.

A pressure-tight electrical feedthrough 67B is sealed in place within a bore 68 in terminal bulkhead 34C. Electrical feedthrough 67B comprises electrical conductors that engage electrical conductors of connector 67A when female part 65 is fully engaged with male part 63. Electrical feedthrough 67B carries electrical conductors to a connection block 67C of a mud pulse motor 82 (or other device that is outside of but controlled by or otherwise in electrical or optical communication with probe 30). In alternative embodiments, feedthrough 67B is integrated with connection block 67C. In other alternative embodiments, feedthrough 67B is integrated with a module of the probe and/or with connector 67A (such that a connector 67A is not required).

Coupling 60 may be fastened together using screws 42. The screws may pass through countersunk holes in female part 65 into threaded holes in male part 63. The threaded holes in male part 63 may be blind so that they do not penetrate to bore 68. There may be, for example, four to eight screws 42. As in other embodiments, a suitable bedding compound may be applied around screws 42 and/or between other parts of the coupling.

In some embodiments, assembly of a probe requires a first bulkhead to be turned relative to a second bulkhead. An example of this is the case where first and second bulkheads 34 are threadedly engaged at opposing ends of a tubular section 33. If the threads at both ends have the same handedness (e.g. both right-handed or both left-handed) then, after the tubular section has been screwed onto one end of the first bulkhead, screwing the second bulkhead into the other end of the tubular section requires the second bulkhead to be turned relative to the first bulkhead. This would not be possible if a string of one or more modules 32 were non-rotationally coupled to both the first and second bulkheads. In such embodiments, where it is desired to couple modules together through both the first and second bulkheads, some provision must be made to allow relative rotation of the first and second bulkheads. It would be desirable to provide a coupling that can provide the desired electrical connections despite relative rotations of the parts being coupled.

Another issue is that coupling the first and second bulkheads together by a tubular section 33 draws the first and second bulkheads together. The final distance between the first and second bulkheads may depend on exactly how tight each of the threaded connections is. This final distance may, therefore, be somewhat variable. It would be desirable to provide a coupling that can provide the desired electrical connections despite variations in the axial positioning of modules being coupled.

FIG. 6 illustrates a rotary coupling 70 that may be applied where relative rotation may occur between connected modules (either in the process of assembling a probe or for some other reason). Rotary coupling 70 comprises a male part comprising a projection 71 and a female part comprising a sleeve 75. The male part is electrically connected to one module and the female part is electrically connected to another module. As described below, the male and/or female parts of rotary coupling 70 may extend through a bore of a bulkhead (this is not mandatory in all embodiments).

Projection 71 supports circumferential electrically-conducting bands 72 spaced apart on its outer surface. Each band 72 is electrically connected to a conductor (not shown) that extends through projection 71 to connect to appropriate components within the module from which projection 71 extends. Projection 71 may, itself, be made of a suitable electrical insulator such as a suitable electrically-insulating plastic. Projection 71 is concentric with the module.

Projection 71 is received within a sleeve 73 which has brushes 74 on its inner aspect. Brushes 74 are spaced apart longitudinally with a spacing that matches the spacing between bands 72. When projection 71 is inserted into sleeve 75 to an appropriate depth, brushes 74 make electrical contact with bands 72, thereby establishing a plurality of electrical connections between the modules. While both bands 72 and brushes 74 are shown as extending fully circumferentially this is not mandatory. One or both of brushes 74 and bands 72 could have some gaps without necessarily impairing their function.

In cases where undesirable consequences could flow if electrical connections were made between one or more brushes 74 and one or more wrong ones of bands 72, bands 72 may be of different diameters. Smaller-diameter bands 72 may be at the leading (distal) end of projection 71 while larger-diameter bands 72 are located closer to the base of projection 71. Brushes 74 may also vary in diameter. With this construction, when projection 71 first enters sleeve 75 the smaller-diameter bands 72 near its tip can pass through without electrically contacting larger-diameter brushes 74.

Projection 71 and/or sleeve 75 may be supported in various ways. In some embodiments, projection 71 projects directly from one end of a module 32. In other embodiments, projection 71 comprises a separate part that can be coupled to a module 32. In some embodiments, projection 71 comprises a part that can be engaged with a bulkhead 34 and coupled to a module 32 when the module 32 is coupled to the bulkhead 34. One advantage of the illustrated embodiment is that projection 71 can be readily removed and replaced. No soldering is required.

Figure 6A:
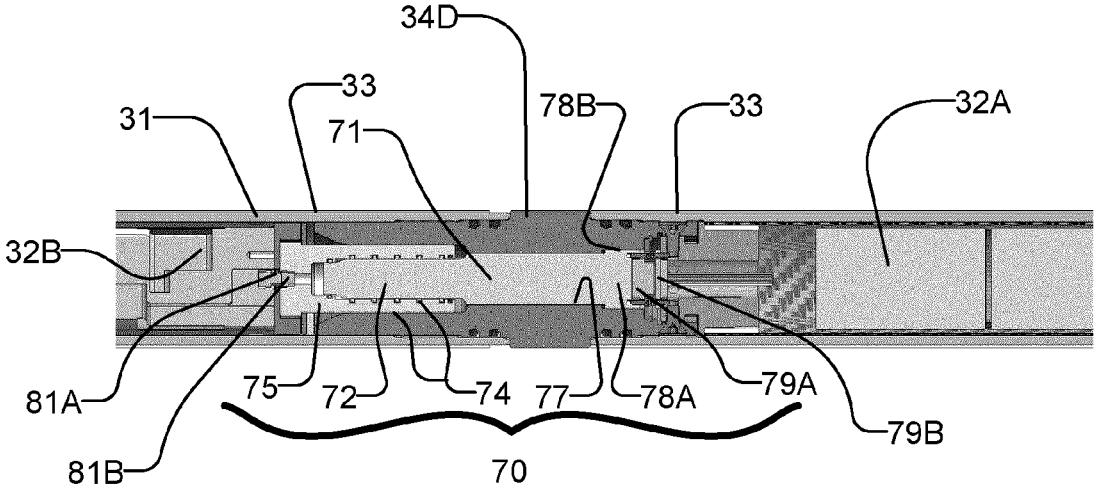
FIG. 6A is a longitudinal cross section of a coupling generally like that of FIG. 6.

As shown in FIGS. 6 and 6A, projection 71 may pass through a bore 77 in a bulkhead 34D. In the illustrated embodiment, sleeve 75 is received in a portion of bore 77 that is enlarged in diameter. Both projection 71 and sleeve 75 may have a close-tolerance fit to bore 77. For example, projection 71and sleeve 75 may each have a tight running fit in the portions of bore 77 through which they pass.

In the illustrated embodiment, projection 71 fits into bore 77 and is prevented from turning in bore 77 by engagement of a non-round head 78A in a complementary-shaped recess 78B. Projection 71 comprises an electrical connector 79A that engages a mating electrical connector 79B on module 32A. Projection 71 is prevented from moving axially relative to bulkhead 34D by module 32A which is coupled to bulkhead 34D (for example by one of the constructions described above).

As can be seen, for example in FIG. 6, coupling 70 may be constructed in such a manner that projection 71 is supported against transverse motion over all or substantially all of its length. Similarly, sleeve 75 may be supported against transverse motion over all or substantially all of its length.

Sleeve 75 is attached to a module 32B. In the illustrated embodiment, screws 80 extend through holes in a flange affixed to sleeve 75 to affix sleeve 75 to module 32B. An electrical connector 81A mounted on module 32B is electrically coupled to a mating electrical connector 81B mounted to sleeve 75. Contacts in electrical connector 81B are electrically connected to corresponding brushes 74 in sleeve 75 by electrical conductors (not shown). In alternative embodiments, sleeve 75 is integral with an end cap or other part of module 32B.

It can be appreciated that coupling 70 can accommodate relative rotation between bulkhead 34D and module 32B as may occur, for example, as bulkhead 34D is being coupled to tubular section 33. Coupling 70 may also accommodate axial movement between sleeve 75 and projection 71 as may occur, for example, as a result of differential thermal expansion of different parts of probe 30 or modules within probe 30. Coupling 70 shares the space taken up by bulkhead 34D.

The result is advantageously compact. The support provided by bulkhead 34D can make coupling 70 robust.

Those of skill in the art will appreciate that a probe may be made up of a plurality of modules coupled to one another and to one or more bulkheads by couplings which include non-rotational couplings. The couplings described above are non-limiting examples of suitable non-rotational couplings.

In some embodiments, all couplings but for one coupling comprise non-rotational couplings. In such embodiments one rotational coupling (for example a rotational coupling like coupling 70) is provided to allow a housing of the probe to be closed by screwing parts together and/or to accommodate differential thermal expansion of components of the probe.

Figure 5A:
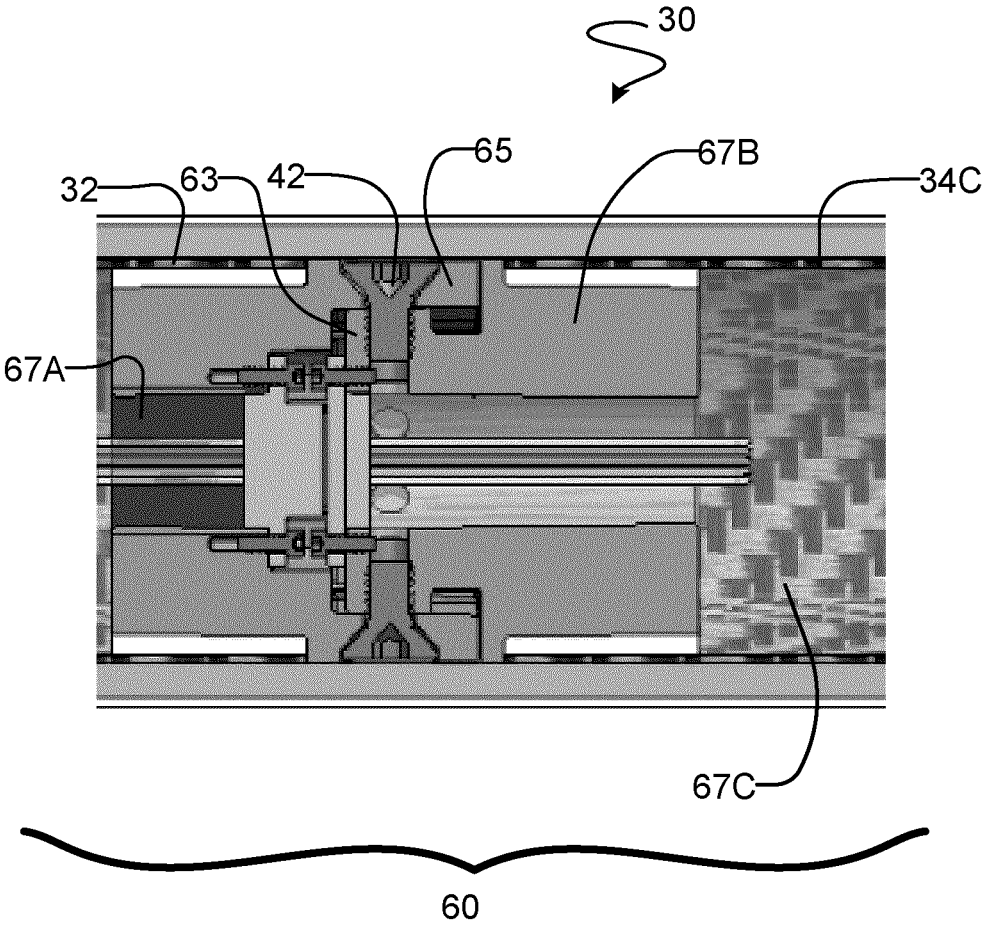
FIG. 5A is a longitudinal cross section of a coupling generally like that of FIG. 5.
Figure 7:
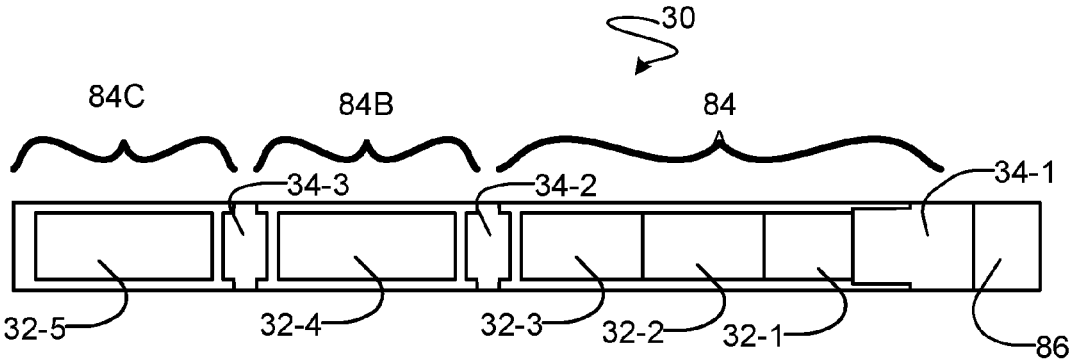
FIG. 7 shows an example probe made up of five modules.

FIG. 7 shows an example probe 30 made up of five modules 32-1, 32-2, 32-3, 32-4 and 32-5. Modules 32-4 and 32-5 contain batteries. Modules 32-1 to 32-3 contain electronics. Probe 30 is designed to couple to a mud pulse motor 86 at a terminal bulkhead 34-1. Probe 30 comprises three sections 84A, 84B and 84C separated by two bulkheads 34-2 and 34-3. In an example alternative embodiment probe 30 comprises two sections and bulkhead 34-3 may be replaced by a coupling between modules 32-4 and 32-5 (the coupling may, for example, be of the type shown in FIG. 5A although this is not mandatory).

Module 32-1 is coupled to terminal bulkhead 34-1, for example with a coupling 50 as described above. Module 32-2 is coupled to module 32-1. Module 32-3 is coupled to module 32-2. The couplings between modules 32-1 and 32-2 and between modules 32-3 and 32-2 may be non-rotational couplings as described above. Advantageously, all of modules 31-1 to 32-3 are coupled to have fixed rotational orientations with respect to terminal bulkhead 34-1. Module 32-3 may be coupled to module 32-4 by a rotational coupling (for example a coupling 70 as described above). Such a coupling facilitates bulkhead 34-2 being installed at the end of section 84A. Module 32-4 may be coupled to bulkhead 34-2. Module 32-5 may be coupled to module 32-4 by a rotational coupling (for example a coupling 70 as described above). Such a coupling facilitates bulkhead 34-3 being installed at the end of section 84B. Module 32-5 may be coupled to bulkhead 34-3.

The couplings between different ones of the modules may be configured so that the modules are not interchangeable. For example, where modules must be coupled together in a specific sequence the couplings may be constructed differently from one another so that it is impossible to couple the probes together in other than the correct sequence. Where the male and female parts are not complementary the couplings may protect electrical connections by blocking the electrical connections from being brought together. Such a construction can avoid damage that might occur if a person attempted to couple two modules together while the electrical connectors of the two modules are misaligned. Male and female connecting parts as described above are one example of connecting parts for a coupling that may be configured to provide such selectivity.

Additionally, the couplings may be configured such that sensors within one or more of the modules are oriented in a desired predetermined orientation relative to the probe housing and, where there are multiple sensors, to other ones of the sensors when the probe is assembled. The couplings may set the orientations of the modules relative to one another and/or to the probe to achieve this goal. Where the probe housing has keys, splines or other features that preserve its orientation relative to a drill string section (e.g. a spider that has keys or other features to engage with corresponding features of a landing within a bore of the drill string section) then the orientation of the sensors may be automatically fixed relative to the drill string section in which the probe is installed in the drill string section. An outside of the drill string section may have features or marks (e.g. scribe lines, marks, indentations, etc.) that identify the orientation of the sensors and allow the relative alignment of other apparatus in the drill string to be readily determined relative to the sensors.

Couplings as described herein may cause proper rotational alignment of modules being coupled to one another and/or to bulkheads before electrical connectors can be brought together. After male and female parts of the couplings are properly aligned and partially engaged, the partial engagement of the male and female parts may constrain the male and female parts to be movable together or apart in a linear motion to either connect or disconnect the electrical connectors. This avoids damage to the electrical connectors which could otherwise occur during attempts to connect the electrical connectors when the electrical connectors are misaligned rotationally or have misaligned axes.

It can be appreciated that the constructions described above permit interconnection of multiple modules without requiring any loose electrical harnesses. All electrical conductors may be immobilized, for example by a suitable potting compound or providing conductors that are routed through passages in substantially rigid members or providing conductors that are substantially rigid themselves. Flexibility in the electrical connections between modules is not required. This construction may significantly improve reliability in comparison to probes having electronics resiliently-supported on snubbers and interconnected by loose wiring harnesses.

One advantage of couplings as described above is that the couplings can be made compact. Modules can extend right up to bulkheads. Wasted space may be reduced. The volume within sections of the probe between bulkheads may be packed more efficiently with components and systems that provide the functions for the probe. The decrease in wasted space may be applied to fit the desired components and systems into fewer probe sections, thereby eliminating some bulkheads. This further reduces the amount of space occupied by the probe that is not housing active components and systems.

As mentioned above, couplings as described herein (or other suitable non-rotational couplings which may be applied to fix the orientations and axial positions of modules within a probe) can maintain a relative orientation between one or more modules and a bulkhead 34. This can facilitate calibration of sensors included in the probe. For example, certain sensors detect vector quantities such as magnetic fields, gravity, and the like or are otherwise directional. It can be important to know how such sensors are oriented in a probe 30. A construction as described herein can ensure that such sensors at least have a fixed orientation relative to a bulkhead 34. A line or other indicia may be marked on the bulkhead 34 to identify the sensor orientation. The bulkhead 34 may include one or more keying or rotational alignment features which allow the probe 34 to be supported in a predetermined orientation within a section of drill string.

Figure 4B:
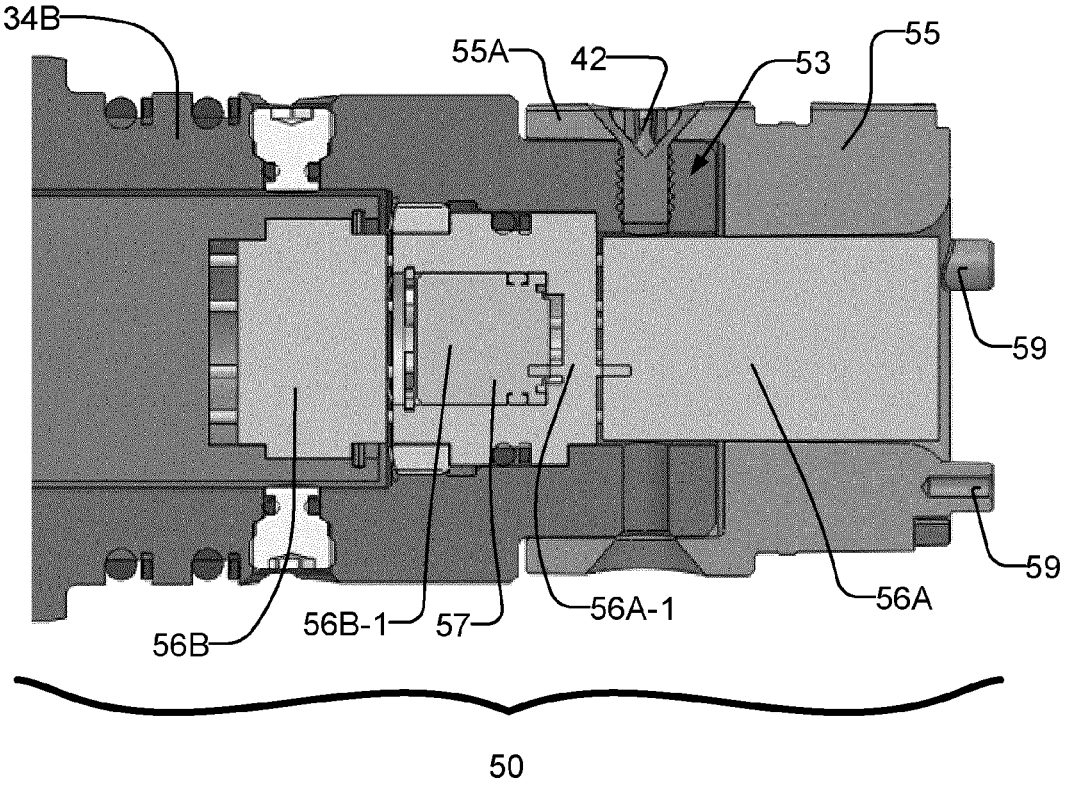
FIG. 4B is a close up view of a portion of the coupling shown in FIG. 4A.

In some embodiments, sensors are supported in modules 32 by circuit boards or other support structures that are keyed to features of the coupling. For example, circuit boards or other supports for directional sensors may be attached to or oriented by engagement with features 59 as illustrated, for example, in FIG. 4B. Such construction can ensure that a sensor will have a known predetermined orientation relative to the coupling. For example, the coupling may comprise mounting features to which a circuit board may be attached in a predetermined orientation. This construction on its own may not eliminate the need to perform calibration of sensors.

It is often desirable to be able to determine the orientation of sensors in a probe after the probe has been installed into a drill string section. In some embodiments, a probe 30 as described herein is constructed to non-rotationally engage with a drill string section in which the probe is mounted. A non-limiting example of one way in which this can be accomplished is illustrated in FIG. 8.

Figure 8:
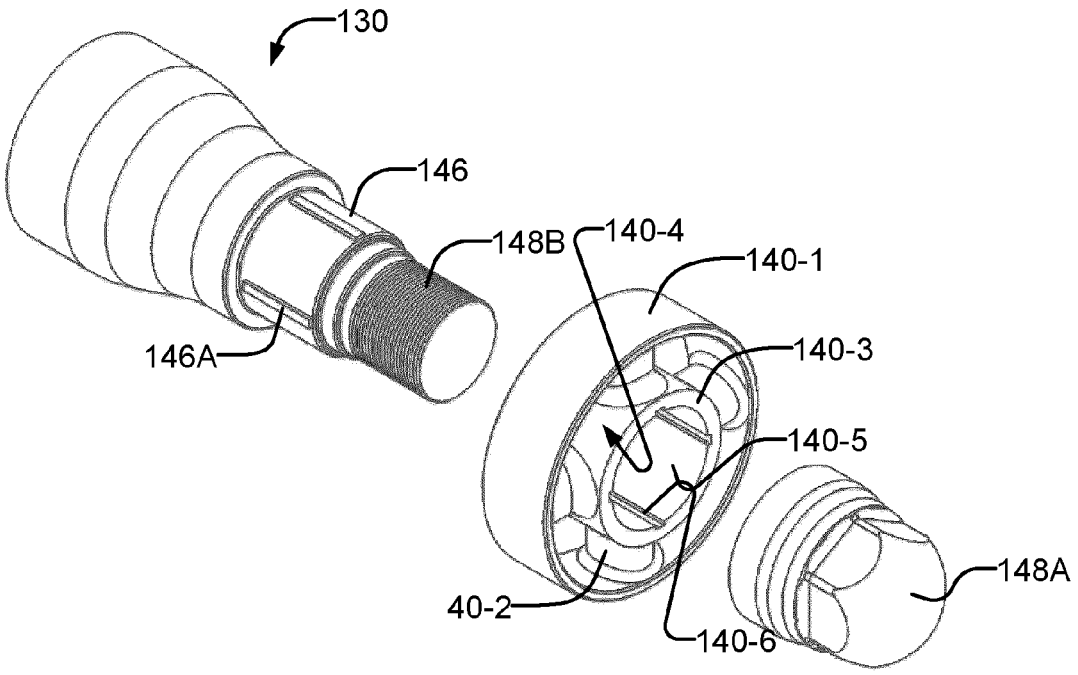
FIG. 8 is an exploded view of the end of a probe showing a non-limiting example structure for coupling a downhole probe non-rotationally into a section of drill string.

FIG. 8 shows an example of how a spider may be used to couple a downhole probe 30 into a section of drill string. A spider 140 has a rim 140-1 supported by arms 140-2 which extend to a hub 140-3 attached to downhole probe 30. Openings 140-4 between arms 140-2 provide space for the flow of drilling fluid past the spider 140.

To prevent relative rotation of spider 140 and probe 30, spider 140 may be integral with a part of the housing of probe 30 or may be keyed, splined, or have a shaped bore that engages a shaped shaft on probe 30 or may be otherwise non-rotationally mounted to probe 30. In the example embodiment shown in FIG. 8, probe 30 comprises a shaft 146 dimensioned to engage a bore 140-5 in hub 140-3 of spider 140. A nut 148A engages threads 148B to secure spider 140 on shaft 146. In the illustrated embodiment, shaft 146 comprises splines 146A which engage corresponding grooves 140-6 in bore 140-5 to prevent rotation of spider 140 relative to shaft 146. Splines 146A may be asymmetrical such that spider 140 can be received on shaft 146 in only one orientation. An opposing end of probe 30 (not shown in FIG. 8) may be similarly configured to support another spider 140.

Spider 140 may also be non-rotationally mounted to a drill string section, for example by way of a key, splines, shaping of the face or edge of rim 140A that engages corresponding shaping within a bore of the drill string section or the like. More than one key may be provided to increase the shear area and resist torsional movement of probe 30 within a bore of a section. In some embodiments one or more keyways, splines or the like for engaging spider 140 are provided on a member that is press-fit, pinned, welded, bolted or otherwise assembled to the bore. In some embodiments the member comprises a ring bearing such features.

Where sensors have predetermined orientations relative to the modules in which they are located, and the modules have known orientations relative to a probe housing and the probe housing has a known orientation relative to a drill string section then a mark or other indicia on an outside surface of the drill string section will have a predetermined orientation relative to the sensors. Consequently, a relative alignment of the sensors with another element of the drill string (for example the high-side of a bent sub as is often used in directional drilling) may be readily determined with reference to the mark or indicia.

Figure 9:
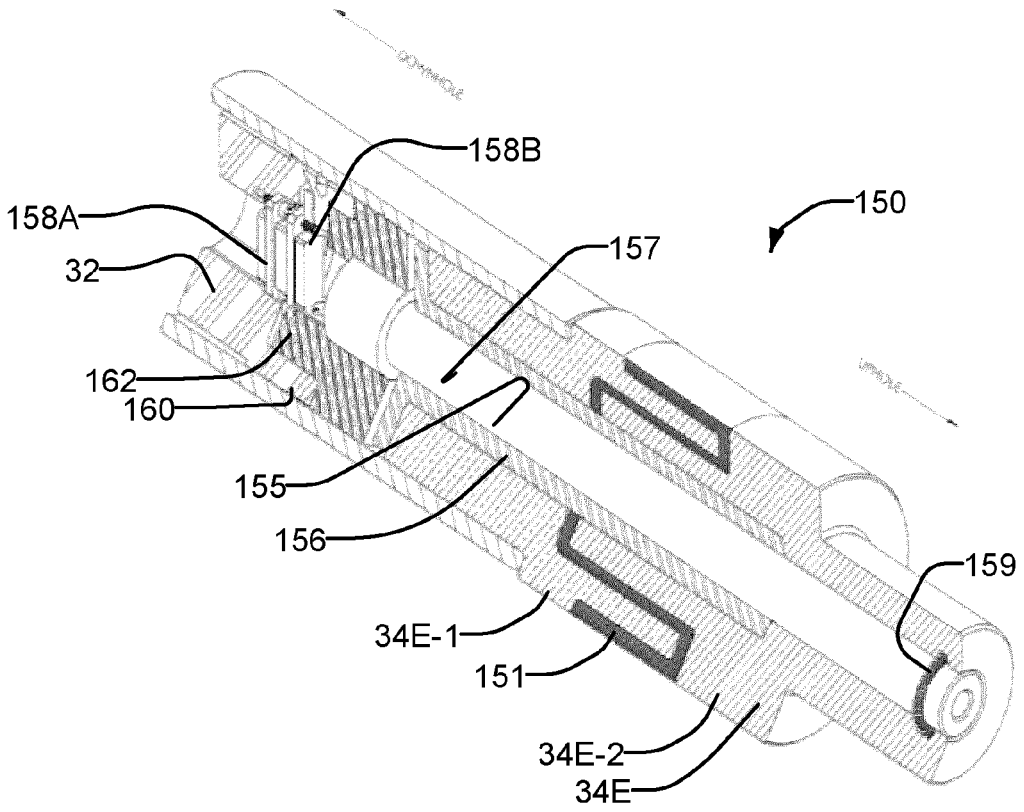
FIGS. 9 and 9A are respectively a partially cut-away view of a gap section of a probe and a longitudinal cross section view of a gap section of a probe.
Figure 9A:
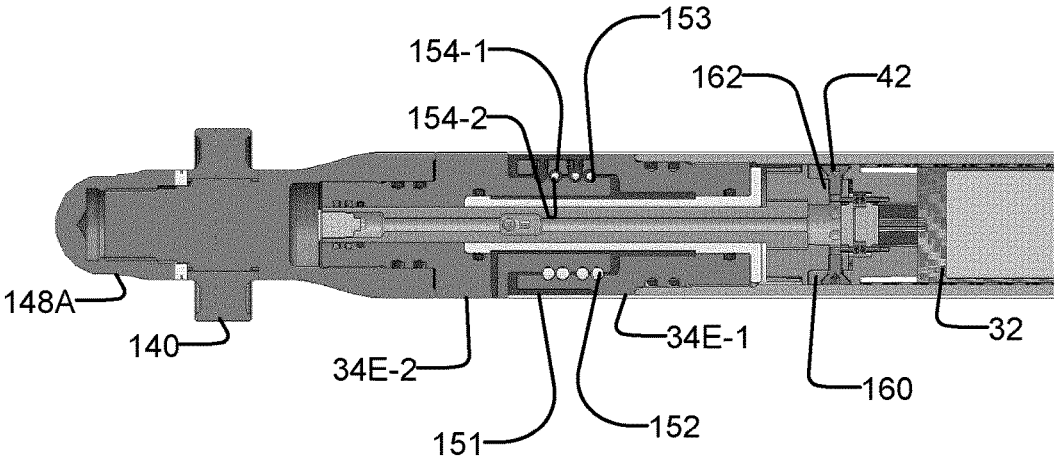

FIG. 9 illustrates a gap assembly 150 that provides another example of ways to reduce or eliminate electrical interconnections by flexible electrical conductors. A gap assembly may have application, for example, in electromagnetic telemetry. Gap sub assembly 150 comprises a bulkhead 34E comprising first and second electrically-conducting parts 34E-1 and 34E-2 separated by an electrically-conducting gap 151. As illustrated in FIG. 9A, parts 34E-1 and 34E-2 may be held together by electrically insulating balls (for example ceramic balls) 152 engaged in channels 153 defined by grooves 154-1 and 154-2 that are respectively in parts 34E-1 and 34E-2. Balls 152 may be inserted into channels 153 through holes that may subsequently be plugged. The rest of insulating gap 151 may be filled with a suitable electrically-insulating material such as a suitable epoxy, for example.

A bore 155 of gap bulkhead 34E is lined with an electrically-insulating liner 156. Electrical signals from a module 32 are carried to part 34E-2 by electrical connectors 158A and 158B which establish a connection with one or more conductors in a projection 157 that fits snugly in bore 155. Projection 157 may, for example, comprise an electrically conductive rod. A canted coil spring 159 or other electrical contact electrically couples projection 157 to part 34E-2.

In the illustrated embodiment, module 32 comprises a female coupling part 160 that is coupled to a male coupling part 162 to support electrical connectors 158A and 158B in engagement with one another. One or both of female part 160 and male part 162 may comprise a molded plastic part. Screws 42 may be provided to hold parts 162 engaged in part 160. Parts 162 and 160 may provide a coupling like coupling 40 or 50 described above, for example.

FIG. 9A shows how a spider 140 may be coupled to part 34E-2. The spider may put part 32E-2 in electrical contact with one part of a gap sub, for example.

In some embodiments, a stiff conductive rod, as illustrated for example in FIG. 9 is used to provide electrical communication between modules. This may be appropriate, for example, in cases where only one line of communication or one power line is required between the modules. For example, signals may be delivered between modules using current modulated communication or voltage modulation communication techniques. Current return and/or voltage reference may be provided, for example, by the probe housing. A stiff electrically conductive rod may also be arranged to permit relative rotation and so may be used in place of a rotary connector (as described above) in cases where a single conductor will suffice.

The components and assemblies described above may be modified in many different ways while preserving overall functionality. Downhole probes may comprise any reasonable combinations and sub-combinations of features as described herein. For example, a downhole probe having a housing comprising one or more bulkheads may be designed to have one or more modules as described herein. The one or more modules may be coupled to bulkheads using suitable rigid couplings (of which the couplings described herein are examples). In some such probes, batteries are housed in separate modules from most or all sensors and other active components. In such probes the modules comprising the batteries may optionally be in one or more sections of the probe that are separated from sections of the probe in which the modules containing active components are housed by one or more bulkheads. Probes as described herein may optionally comprise gap assemblies (as illustrated for example in FIGS. 9 and 9A) and/or external components such as mud pulse motors. Couplings may be mixed and matched. In any of the embodiments described herein, bores through the described couplings may be coaxial with a probe housing. However, this is not mandatory in all embodiments.

In some embodiments all essential electrical connections between and within modules are provided by immobilized electrical conductors. Such embodiments have no flexible wiring harnesses or wires that are free to move within the probe. In some embodiments all important components are rigidly fixed relative to the probe housing. Such embodiments may lack elastomeric suspensions or snubber assemblies.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

Interpretation of Terms

Unless the context clearly requires otherwise, throughout the description and the claims:

"comprise," "comprising," and the like are to be construed in an inclusive sense, as opposed to an exclusive or exhaustive sense; that is to say, in the sense of "including, but not limited to".

"connected," "coupled," or any variant thereof, means any connection or coupling, either direct or indirect, between two or more elements; the coupling or connection between the elements can be physical, logical, or a combination thereof.

"herein," "above," "below," and words of similar import, when used to describe this specification shall refer to this specification as a whole and not to any particular portions of this specification.

"or," in reference to a list of two or more items, covers all of the following interpretations of the word: any of the items in the list, all of the items in the list, and any combination of the items in the list.

the singular forms "a," "an," and "the" also include the meaning of any appropriate plural forms.

Words that indicate directions such as "vertical," "transverse," "horizontal," "upward," "downward," "forward," "backward," "inward," "outward," "vertical," "transverse," "left," "right," "front," "back" ," "top," "bottom," "below," "above," "under," and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A downhole probe comprising:

an elongated housing and first and second modules arranged in a row and fixed relative to one another within the housing, each of the first and second modules comprising one or more electrical components and being electrically connected to the other one of the first and second modules by way of an electrical connection;

wherein the electrical connection comprises:

a first electrical connector attached to the first module and electrically connected to one or more of the electrical components of the first module by one or more immobilized first electrical conductors; and a second electrical connector attached to the second module and electrically connected to one or more of the electrical components of the second module by one or more immobilized second electrical conductors; and the first and second electrical connectors are either directly coupled to one another or electrically connected to one another by immobilized conductors, the first module mechanically coupled to the second module by a non-rotational coupling, the non-rotational coupling comprises a male portion attached to one of the first and second modules and a female portion attached to the other one of the first and second modules, wherein engagement of the male portion and the female portion restricts the relative movement of the first and second modules wherein each of the first and second modules is substantially filled with a potting compound and the first and second electrical connectors are embedded in the potting compound.

2. A downhole probe according to claim 1 wherein the potting compound embeds portions of the first and second electrical connectors.

3. A downhole probe comprising:

an elongated housing and first and second modules arranged in a row and fixed relative to one another within the housing, each of the first and second modules comprising one or more electrical components and being electrically connected to the other one of the first and second modules by way of an electrical connection;

wherein the electrical connection comprises:

a first electrical connector attached to the first module and electrically connected to one or more of the electrical components of the first module by one or more immobilized first electrical conductors; and a second electrical connector attached to the second module and electrically connected to one or more of the electrical components of the second module by one or more immobilized second electrical conductors; and the first and second electrical connectors are either directly coupled to one another or electrically connected to one another by immobilized conductors, the first module mechanically coupled to the second module by a non-rotational coupling, the non-rotational coupling comprises a male portion attached to one of the first and second modules and a female portion attached to the other one of the first and second modules, wherein engagement of the male portion and the female portion restricts the relative movement of the first and second modules wherein the housing comprises first and second bulkheads coupled together by a tubular member and the first module is inside the tubular member.

4. A downhole probe according to claim 3 wherein the tubular member is coupled to the first and second bulkheads by threaded couplings.

5. A downhole probe according to claim 4 wherein the threaded coupling of the tubular member to the first bulkhead comprises threads on an outside surface of the first bulkhead and the projection extends co-axially with the threads and overlaps axially with the threads.

6. A downhole probe according to claim 3 wherein the first module is coupled to the first bulkhead by a coupling that holds the first module axially and prevents rotation of the first module relative to the first bulkhead.

7. A downhole probe according to claim 6 wherein the second module is on an opposing side of the first bulkhead from the first module.

8. A downhole probe according to claim 7 wherein the first and second electrical connectors are electrically connected to one another by immobilized conductors extending through a bore in the first bulkhead.

9. A downhole probe according to claim 7 wherein the coupling comprises a rotary coupling that permits the second module to rotate relative to the first bulkhead.

10. A downhole probe according to claim 9 wherein the first bulkhead is penetrated by a bore, the rotary coupling comprises a sleeve engaged in the bore and a projection having a first part engaged in the bore and a second part projecting axially into the sleeve, wherein electrical connections between one or more conductors in the projection and one or more corresponding conductors in the sleeve are provided between corresponding sets of brushes and conducting rings.

11. A downhole probe according to claim 10 wherein the conducting rings extend circumferentially on an outside diameter of the projection and the brushes are mounted to the sleeve.

12. A downhole probe according to claim 6 wherein the coupling comprises a male part attached to the first bulkhead and a female part attached to the first module, the male part comprising a body that is circular in cross section and has a plurality of longitudinally-extending fins projecting radially on an outside surface thereof.

13. A downhole probe according to claim 12 wherein the female part comprises a cylindrical shell defining an axially-opening cavity dimensioned to receive the body of the male part, the shell having longitudinally extending slits or grooves dimensioned and spaced circumferentially to receive the fins of the male part.

14. A downhole probe according to claim 13 wherein the fins and the corresponding slits or grooves are arranged asymmetrically around the body such that the male part can be engaged with the female part in only one orientation.

15. A downhole probe according to claim 6 wherein the non-rotational coupling that couples the first module to the second module comprises a male part attached to one of the first and second modules and a female part attached to the other one of the first and second modules, the male part comprising a body and a plurality of longitudinally-extending fins projecting radially on an outside surface thereof.

16. A downhole probe according to claim 15 wherein the female part comprises a shell defining an axially-opening cavity dimensioned to receive the body of the male part, the shell having longitudinally extending slits or grooves dimensioned and spaced circumferentially to receive the fins of the male part.

17. A downhole probe according to claim 16 wherein the fins and the corresponding slits or grooves are arranged asymmetrically around the body such that the male part can be engaged with the female part in only one relative orientation.

18. A downhole probe according to claim 17 wherein the coupling comprises a plurality of threaded fasteners passing through apertures in the shell into threaded openings in the body.

19. A downhole probe according to any claim 18 wherein the fasteners comprise screws.

20. A downhole probe comprising:

an elongated housing and first and second modules arranged in a row and fixed relative to one another within the housing, each of the first and second modules comprising one or more electrical components and being electrically connected to the other one of the first and second modules by way of an electrical connection;

wherein the electrical connection comprises:

a first electrical connector attached to the first module and electrically connected to one or more of the electrical components of the first module by one or more immobilized first electrical conductors; and a second electrical connector attached to the second module and electrically connected to one or more of the electrical components of the second module by one or more immobilized second electrical conductors; and the first and second electrical connectors are either directly coupled to one another or electrically connected to one another by immobilized conductors, the first module mechanically coupled to the second module by a non-rotational coupling, the non-rotational coupling comprises a male portion attached to one of the first and second modules and a female portion attached to the other one of the first and second modules, wherein engagement of the male portion and the female portion restricts the relative movement of the first and second modules wherein at least one of the modules comprises one or more directional sensors, the one or more directional sensors are mounted at a predetermined orientation within the module by fixed mechanical coupling between a member on which the one or more sensors is mounted and a coupling of the module wherein the probe comprises one or more external orientation features and the one or more directional sensors have predetermined fixed orientations relative to the external orientation features.

21. A downhole probe comprising:

an elongated housing and first and second modules arranged in a row and fixed relative to one another within the housing, each of the first and second modules comprising one or more electrical components and being electrically connected to the other one of the first and second modules by way of an electrical connection;

wherein the electrical connection comprises:

a first electrical connector attached to the first module and electrically connected to one or more of the electrical components of the first module by one or more immobilized first electrical conductors; and a second electrical connector attached to the second module and electrically connected to one or more of the electrical components of the second module by one or more immobilized second electrical conductors; and the first and second electrical connectors are either directly coupled to one another or electrically connected to one another by immobilized conductors, the first module mechanically coupled to the second module by a non-rotational coupling, the non-rotational coupling comprises a male portion attached to one of the first and second modules and a female portion attached to the other one of the first and second modules, wherein engagement of the male portion and the female portion restricts the relative movement of the first and second modules wherein at least one of the modules comprises one or more directional sensors, the one or more directional sensors are mounted at a predetermined orientation within the module by fixed mechanical coupling between a member on which the one or more sensors is mounted and a coupling of the module wherein the probe comprises one or more orientation features for fixing an orientation of the probe in a drill string section and the sensors have a fixed predetermined orientation relative to the orientation features.

22. A downhole probe comprising:

an elongated housing and first and second modules arranged in a row and fixed relative to one another within the housing, each of the first and second modules comprising one or more electrical components and being electrically connected to the other one of the first and second modules by way of an electrical connection;

wherein the electrical connection comprises:

a first electrical connector attached to the first module and electrically connected to one or more of the electrical components of the first module by one or more immobilized first electrical conductors; and a second electrical connector attached to the second module and electrically connected to one or more of the electrical components of the second module by one or more immobilized second electrical conductors; and the first and second electrical connectors are either directly coupled to one another or electrically connected to one another by immobilized conductors, the first module mechanically coupled to the second module by a non-rotational coupling, the non-rotational coupling comprises a male portion attached to one of the first and second modules and a female portion attached to the other one of the first and second modules, wherein engagement of the male portion and the female portion restricts the relative movement of the first and second modules wherein at least one of the modules comprises one or more directional sensors, the one or more directional sensors are mounted at a predetermined orientation within the module by fixed mechanical coupling between a member on which the one or more sensors is mounted and a coupling of the module wherein a plurality of the modules each comprises at least one of the one or more directional sensors and for each of the modules the directional sensors are mounted at a predetermined orientation within the module by fixed mechanical coupling between a member on which the one or more sensors is mounted and a coupling of the module and relative orientations of the directional sensors in different ones of the modules are fixed by non-rotational couplings between the modules.

23. A downhole probe comprising:

an elongated housing and first and second modules arranged in a row and fixed relative to one another within the housing, each of the first and second modules comprising one or more electrical components and being electrically connected to the other one of the first and second modules by way of an electrical connection;

wherein the electrical connection comprises:

a first electrical connector attached to the first module and electrically connected to one or more of the electrical components of the first module by one or more immobilized first electrical conductors; and a second electrical connector attached to the second module and electrically connected to one or more of the electrical components of the second module by one or more immobilized second electrical conductors; and the first and second electrical connectors are either directly coupled to one another or electrically connected to one another by immobilized conductors, the first module mechanically coupled to the second module by a non-rotational coupling, the non-rotational coupling comprises a male portion attached to one of the first and second modules and a female portion attached to the other one of the first and second modules, wherein engagement of the male portion and the female portion restricts the relative movement of the first and second modules wherein at least one of the modules comprises one or more directional sensors, the one or more directional sensors are mounted at a predetermined orientation within the module by fixed mechanical coupling between a member on which the one or more sensors is mounted and a coupling of the module wherein at least two of the modules each contains one of the one or more directional sensors and the one or more directional sensors are aligned to a common reference direction.

24. A downhole probe comprising:

an elongated housing and first and second modules arranged in a row and fixed relative to one another within the housing, each of the first and second modules comprising one or more electrical components and being electrically connected to the other one of the first and second modules by way of an electrical connection;

wherein the electrical connection comprises:

a first electrical connector attached to the first module and electrically connected to one or more of the electrical components of the first module by one or more immobilized first electrical conductors; and a second electrical connector attached to the second module and electrically connected to one or more of the electrical components of the second module by one or more immobilized second electrical conductors; and the first and second electrical connectors are either directly coupled to one another or electrically connected to one another by immobilized conductors, the first module mechanically coupled to the second module by a non-rotational coupling, the non-rotational coupling comprises a male portion attached to one of the first and second modules and a female portion attached to the other one of the first and second modules, wherein engagement of the male portion and the female portion restricts the relative movement of the first and second modules wherein the probe comprises a gap assembly comprising two electrically-conductive portions of the probe housing separated by an electrically-insulating gap, one of the modules is rigidly coupled to the first electrically-conductive portion of the probe housing by a non-rotational coupling and an electrical connection between the module and the second electrically-conductive portion of the probe housing is made at least in part by a stiff electrically conductive rod extending through an aperture in the first electrically-conductive portion.

25. A downhole probe according to claim 24 wherein the electrically-conductive rod is electrically connected to the one of the modules by an electrical connector that is integrated into the non-rotational coupling.

26. A downhole probe comprising:

an elongated housing and first and second modules arranged in a row and fixed relative to one another within the housing, each of the first and second modules comprising one or more electrical components and being electrically connected to the other one of the first and second modules by way of an electrical connection;

wherein the electrical connection comprises:

a first electrical connector attached to the first module and electrically connected to one or more of the electrical components of the first module by one or more immobilized first electrical conductors; and a second electrical connector attached to the second module and electrically connected to one or more of the electrical components of the second module by one or more immobilized second electrical conductors; and the first and second electrical connectors are either directly coupled to one another or electrically connected to one another by immobilized conductors, the first module mechanically coupled to the second module by a non-rotational coupling, the non-rotational coupling comprises a male portion attached to one of the first and second modules and a female portion attached to the other one of the first and second modules, wherein engagement of the male portion and the female portion restricts the relative movement of the first and second modules wherein electrical connection between the first and second modules is provided in part by a rigidly supported electrically-conductive rod.

27. A downhole probe comprising:

a housing comprising a plurality of bulkheads including first and second terminal bulkheads at either end of the probe and at least one intermediate bulkhead between the terminal bulkheads and a tubular shell extending between the terminal bulkheads, the tubular shell interrupted by and coupled to each of the at least one intermediate bulkheads, a first one or more of the plurality of modules contained within a first section of the tubular shell coupled to one side of a first one of the intermediate bulkheads and a second of the plurality of modules contained within a second section of the tubular shell coupled to an opposing side of the first intermediate bulkhead, wherein the one or more of the plurality of modules are rigidly anchored to the housing and the second module is electrically coupled to the first one or more modules by a rotary coupling comprising a projection that extends through and is supported within a bore passing through the first intermediate bulkhead, the projection supported against transverse motion over substantially all of its length.

28. A downhole probe according to claim 27 wherein the second module comprises a plurality of batteries and is connected to supply electrical power to the first module by way of the rotary coupling.

29. A rotary coupling for use in a downhole probe, the rotary coupling comprising:

a bulkhead having a central bore, an outside of the bulkhead comprising threads for coupling the bulkhead to a tubular housing section;

a sleeve supported within the bore, the sleeve comprising a cylindrical cavity;

a male projection extending through the bore into the sleeve, the male projection having a first part snuggly fitted in the bore and a second part extending into the sleeve, the second part comprising a plurality of circumferential conductive bands spaced apart along the male projection wherein at least one of the circumferential conductive bands at a leading end of the second part has a diameter smaller than those located at the base of the second part; and, one or more brushes on the sleeve and arranged to contact the conductive bands.

30. A rotary coupling according to claim 29 wherein the male projection comprises a head and the head is non-rotationally engaged in a corresponding recess within the bulkhead.

31. A downhole probe comprising:

a housing comprising a plurality of tubular sections coupled together by bulkheads;

a plurality of electronics modules within the housing, the plurality of electronics modules including a first module on a first side of a first one of the bulkheads and a second module on a second side of the first bulkhead;

the first module comprising a male connector part comprising a cylindrical hub carrying longitudinally-extending fins;

the bulkhead comprising a recess dimensioned to receive the hub, with longitudinal grooves arranged to receive the fins in a wall of the recess and a bore extending from the recess through the bulkhead;

the first and second modules electrically interconnected by an electrical coupling;

at least one of the first and second modules comprising a member extending into the bore, the member rigidly supporting one or more electrical conductors connected to the other one of the first and second modules.

32. A downhole probe according to claim 31 wherein the recess is tapered in diameter.

33. A downhole probe according to claim 31 wherein the fins and grooves are arranged asymmetrically.

34. A downhole probe according to claim 31 wherein the male part has 4 to 8 fins.

35. A downhole probe according to claim 31 comprising fasteners extending radially through the bulkhead into the male connector part.

36. A downhole probe according to claim 35 wherein the bulkhead comprises external threads and is threadedly coupled to the tubular parts.

37. A downhole probe according to claim 36 wherein the fasteners have heads countersunk below a level of a root of the external thread on the bulkhead.

* * * * *